US007837596B2

(12) United States Patent
Astilean

(10) Patent No.: US 7,837,596 B2
(45) Date of Patent: Nov. 23, 2010

(54) PORTABLE DEVICE FOR WEIGHT LOSS AND IMPROVING PHYSICAL FITNESS AND METHOD THEREFOR

(76) Inventor: Aurel A. Astilean, 196 Buckskill Rd., East Hampton, NY (US) 11937

( * ) Notice: Subject to any disclaimer, the term of this patent is extended or adjusted under 35 U.S.C. 154(b) by 1535 days.

(21) Appl. No.: 11/177,722

(22) Filed: Jul. 8, 2005

(65) Prior Publication Data

US 2006/0183603 A1 Aug. 17, 2006

Related U.S. Application Data

(63) Continuation-in-part of application No. 11/058,703, filed on Feb. 15, 2005, now abandoned.

(51) Int. Cl.
*A63B 71/00* (2006.01)

(52) U.S. Cl. ..... 482/8; 482/1; 482/9; 482/901; 434/247; 600/300

(58) Field of Classification Search ..... 482/1–9, 482/900–902; 434/247; 600/300; 601/23
See application file for complete search history.

(56) References Cited

U.S. PATENT DOCUMENTS

| | | | |
|---|---|---|---|
| 5,318,487 | A | 6/1994 | Golen et al. |
| 5,796,640 | A | 8/1998 | Sugarman et al. |
| 6,013,007 | A | 1/2000 | Root |
| 6,032,108 | A | 2/2000 | Seiple |
| 6,040,531 | A | 3/2000 | Miller-Kovach |
| 6,095,951 | A | 8/2000 | Skowronski et al. |
| 6,132,391 | A | 10/2000 | Onari |
| 6,198,431 | B1 | 3/2001 | Gibson |
| 6,324,124 | B1 | 11/2001 | Yuzuki |
| 6,388,613 | B1 | 5/2002 | Nagatsuma |
| 6,450,922 | B1 | 9/2002 | Henderson |
| 6,463,385 | B1 | 10/2002 | Fry |
| 6,519,491 | B2 | 2/2003 | Ishikawa et al. |

(Continued)

OTHER PUBLICATIONS

Kenneth H. Cooper, M.D., Aerobics Program for Total Well-Being: Exercise, Diet, and Emotional Balance, Book: Published in U.S., 1982, M. Evan & Co., Inc.

(Continued)

*Primary Examiner*—Glenn Richman
(74) *Attorney, Agent, or Firm*—Espinosa|Trueba, PL; William R. Trueba, Jr.; Michael E. Tschupp

(57) ABSTRACT

A portable, electronic device having wireless location or positioning technology used to test and improve the physical fitness of a person is provided. The device includes a memory, an operating program, a user interface, a display and a location signal receiver adapted to receive location signals from a plurality of sources external to the fitness training device. A command and control circuit is coupled to the memory, the user interface, the display and the location signal receiver. The control circuit executes the program and generates control signals based upon the user entered data and the location signals from the receiver. The device tracks the distance traveled by the device throughout the performance of an exercise routine based upon the location signals and thereby determines the fitness level of the person. The program then determines a plurality of timed exercise regimens based upon the calculated fitness level.

10 Claims, 9 Drawing Sheets

U.S. PATENT DOCUMENTS

| | | | | |
|---|---|---|---|---|
| 6,538,215 | B2 | 3/2003 | Montagnino et al. | |
| 6,571,200 | B1 | 5/2003 | Mault | |
| 6,626,803 | B1 | 9/2003 | Oglesby et al. | |
| 6,663,564 | B2 | 12/2003 | Miller-Kovach et al. | |
| 6,677,858 | B1 | 1/2004 | Faris | |
| 6,736,759 | B1 | 5/2004 | Stubbs | |
| 6,740,007 | B2 | 5/2004 | Gordon | |
| 6,783,482 | B2 | 8/2004 | Oglesby et al. | |
| 6,795,375 | B2 | 9/2004 | Streja | |
| 6,850,844 | B1 | 2/2005 | Walters | |
| 7,128,693 | B2 * | 10/2006 | Brown et al. | 482/8 |
| 7,278,966 | B2 * | 10/2007 | Hjelt et al. | 600/300 |
| 2002/0116147 | A1 | 8/2002 | Vock | |

OTHER PUBLICATIONS

The Williams Pace Calculator; website: pacewear.com.

* cited by examiner 20 44

| # of Reps | 10 Reps | 9 Reps | 8 Reps | 7 Reps | 6 Reps | 5 Reps | 4 Reps | 3 Reps | 2 Reps | 1 Rep | |
|---|---|---|---|---|---|---|---|---|---|---|---|
| Miles per Hour | | | | | | | | | | | Minutes per Mile 46 |
| 10 | 266m 10/1 0.16M | 533m 10/2 0.33M | 800m 10/3 0.50M | 1064m 10/4 0.67M | 1330m 10/5 0.82M | 1600m 10/6 1.00M | 1860m 10/7 1.16M | 2140m 10/8 1.33M | 2400m 10/9 1.50M | 2660m 10/10 1.67M | 6.00 |
| 9 | 250m 9/1 0.15M | 480m 9/2 0.30M | 720m 9/3 0.45M | 960m 9/4 0.60M | 1200m 9/5 0.75M | 1440m 9/6 0.90M | 1680m 9/7 1.05M | 1920m 9/8 1.20M | 2160m 9/9 1.35M | 2400m 9/10 1.50M | 6.40 |
| 8 | 214m 8/1 0.13M | 426m 8/2 0.26M | 640m 8/3 0.40M | 853m 8/4 0.53M | 1064m 8/5 0.67M | 1280m 8/6 0.80M | 1488m 8/7 0.93M | 1711m 8/8 1.07M | 1920m 8/9 1.20M | 2140m 8/10 1.33M | 7.30 |
| 7.5 | 200m 7.5/1 0.12M | 400m 7.5/2 0.25M | 600m 7.5/3 0.37M | 800m 7.5/4 0.50M | 1000m 7.5/5 0.62M | 1200m 7.5/6 0.75M | 1400m 7.5/7 0.87M | 1600m 7.5/8 1.00M | 1800m 7.5/9 1.12M | 2000m 7.5/10 1.25M | 8.00 |
| 7 | 186m 7/1 0.11M | 373m 7/2 0.23M | 560m 7/3 0.35M | 746m 7/4 0.42M | 931m 7/5 0.59M | 1120m 7/6 0.70M | 1330m 7/7 0.87M | 1488m 7/8 0.93M | 1680m 7/9 1.05M | 1860m 7/10 1.16M | 8.30 |
| 6 | 160m 6/1 0.10M | 320m 6/2 0.20M | 480m 6/3 0.30M | 640m 6/4 0.40M | 800m 6/5 0.50M | 960m 6/6 0.60M | 1120m 6/7 0.70M | 1280m 6/8 0.80M | 1440m 6/9 0.90M | 1600m 6/10 1.00M | 10.00 |
| 5 (89) | 133m 5/1 0.08M | 266m 5/2 0.18M | 400m 5/3 0.25M | 533m 5/4 0.33M | 665m 5/5 0.41M | 800m 5/6 0.50M | 931m 5/7 0.59M | 1064m 5/8 0.67M | 1200m 5/9 0.75M | 1330m 5/10 0.82M | 12.00 |
| 4 (88) | 106m 4/1 0.07M | 214m 4/2 0.13M | 320m 4/3 0.20M | 426m 4/4 0.26M | 533m 4/5 0.33M | 640m 4/6 0.40M | 746m 4/7 0.47M | 853m 4/8 0.53M | 960m 4/9 0.60M | 1064m 4/10 0.67M | 15.00 |
| 3 (86) | 80m 3/1 0.05M | 150m 3/2 0.10M | 240m 3/3 0.15M | 320m 3/4 0.20M | 400m 3/5 0.25M | 480m 3/6 0.30M | 560m 3/7 0.35M | 640m 3/8 0.40M | 720m 3/9 0.45M | 800m 3/10 0.50M | 20.00 |
| 2 | 53m 2/1 0.03M | 106m 2/2 0.07M | 160m 2/3 0.10M | 214m 2/4 0.13M | 266m 2/5 0.16M | 320m 2/6 0.20M | 373m 2/7 0.23M | 426m 2/8 0.26M | 480m 2/9 0.30M | 533m 2/10 0.33M | 30.00 |
| 1 | 26m 1/1 0.01M | 53m 1/2 0.03M | 80m 1/3 0.05M | 106m 1/4 0.07M | 133m 1/5 0.08M | 160m 1/6 0.10M | 186m 1/7 0.11M | 214m 1/8 0.13M | 240m 1/9 0.15M | 266m 1/10 0.16M (82) | 60.00 |
| Time 42 | 1 | 2 | 3 | 4 | 5 | 6 | 7 | 8 | 9 | 10 | |

40 48 32 34 10

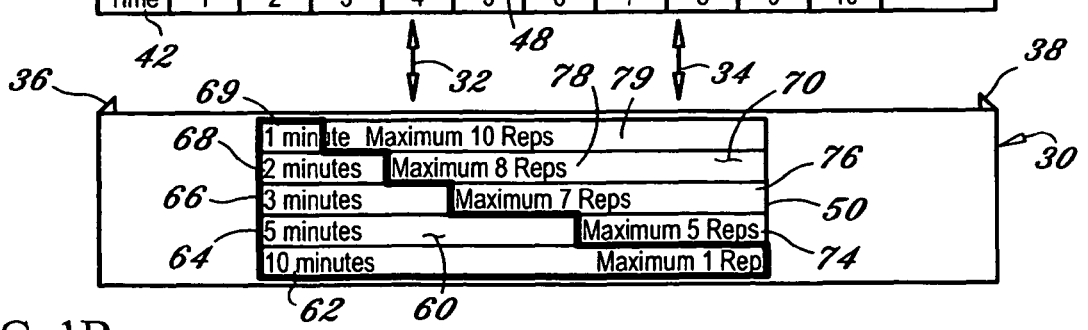

FIG. 1B

20

44

| # of Reps | 10 Reps | 9 Reps | 8 Reps | 7 Reps | 6 Reps | 5 Reps | 4 Reps | 3 Reps | 2 Reps | 1 Rep | |
|---|---|---|---|---|---|---|---|---|---|---|---|
| Miles per Hour | | | | | | | | | | | Minutes per Mile |
| 20 | 533m 20/1 0.33M | 1064m 20/2 0.67M | 1600m 20/3 1.00M | 2133m 20/4 1.67M | 2664m 20/5 1.67M | 3200m 20/6 1.00M | 3733m 20/7 2.33M | 4264m 20/8 2.67M | 4800m 20/9 3.00M | 5533m 20/10 3.33M | 3.00 |
| 19 | 540m 19/1 0.32M | 1020m 19/2 0.63M | 1530m 19/3 0.95M | 2040m 19/4 1.28M | 2550m 19/5 1.59M | 3060m 19/6 1.90M | 3570m 19/7 2.22M | 4080m 19/8 2.54M | 4590m 19/9 2.86M | 5100m 19/10 3.17M | 3.10 |
| 18 | 480m 18/1 0.30M | 960m 18/2 0.60M | 1440m 18/3 0.90M | 1920m 18/4 1.20M | 2400m 18/5 1.50M | 2880m 18/6 1.80M | 3360m 18/7 2.10M | 3840m 18/8 2.40M | 4340m 18/9 2.70M | 4800m 18/10 3.02M | 3.20 |
| 17 | 450m 17/1 0.28M | 900m 17/2 0.57M | 1350m 17/3 0.85M | 1800m 17/4 1.14M | 2250m 17/5 1.42M | 2700m 17/6 1.71M | 3200m 17/7 2.00M | 3600m 17/8 2.27M | 4000m 17/9 2.56M | 4500m 17/10 2.85M | 3.30 |
| 16 | 426m 16/1 0.26M | 853m 16/2 0.53M | 1280m 16/3 0.80M | 1706m 16/4 1.07M | 2133m 16/5 1.33M | 2560m 16/6 1.60M | 3000m 16/7 1.87M | 3440m 16/8 2.14M | 3880m 16/9 2.41M | 4310m 16/10 2.68M | 3.45 |
| 15 | 400m 15/1 0.25M | 800m 15/2 0.50M | 1200m 15/3 0.75M | 1600m 15/4 1.00M | 2000m 15/5 1.25M | 2400m 15/6 1.50M | 2800m 15/7 1.75M | 3200m 15/8 2.00M | 3600m 15/9 2.25M | 4000m 15/10 2.50M | 4.00 |
| 14 | 373m 14/1 0.23M | 746m 14/2 0.47M | 1120m 14/3 0.93M | 1488m 14/4 0.93M | 1860m 14/5 1.16M | 2240m 14/6 1.40M | 2600m 14/7 1.62M | 3000m 14/8 1.86M | 3360m 14/9 2.10M | 3733m 14/10 2.33M | 4.15 |
| 13 | 350m 13/1 0.22M | 700m 13/2 0.44M | 1050m 13/3 0.66M | 1400m 13/4 0.88M | 1750m 13/5 1.10M | 2100m 13/6 1.32M | 2450m 13/7 1.54M | 2800m 13/8 1.76M | 3150m 13/9 1.98M | 3500m 13/10 2.20M | 4.35 |
| 12 | 320m 12/1 0.20M | 640m 12/2 0.40M | 960m 12/3 0.60M | 1280m 12/4 0.80M | 1600m 12/5 1.00M | 1920m 12/6 1.20M | 2240m 12/7 1.40M | 2560m 12/8 1.60M | 2880m 12/9 1.80M | 3200m 12/10 2.00M | 5.00 |
| 11 | 290m 11/1 0.18M | 600m 11/2 0.37M | 890m 11/3 0.55M | 1170m 11/4 0.73M | 1480m 11/5 0.92M | 1770m 11/6 1.10M | 2000m 11/7 1.25M | 2320m 11/8 1.44M | 2600m 11/9 1.62M | 2900m 11/10 1.80M | 5.30 |
| Time | 1 | 2 | 3 | 4 | 5 | 6 | 7 | 8 | 9 | 10 | |

46

40

42

FIG. 1C

20

44

| # of Reps | 10 Reps | 9 Reps | 8 Reps | 7 Reps | 6 Reps | 5 Reps | 4 Reps | 3 Reps | 2 Reps | 1 Rep | |
|---|---|---|---|---|---|---|---|---|---|---|---|
| Miles per Hour | | | | | | | | | | | Minutes per Mile |
| 20 | 533m | 1064m | 1600m | 2133m | 2664m | 3200m | 3733m | 4264m | 4800m | 5533m | 3.00 |
| 19 | 540m | 1020m | 1530m | 2040m | 2550m | 3060m | 3570m | 4080m | 4590m | 5100m | 3.10 |
| 18 | 480m | 960m | 1440m | 1920m | 2400m | 2880m | 3360m | 3840m | 4340m | 4800m | 3.20 |
| 17 | 450m | 900m | 1350m | 1800m | 2250m | 2700m | 3200m | 3600m | 4000m | 4500m | 3.30 |
| 16 | 426m | 853m | 1280m | 1706m | 2133m | 2560m | 3000m | 3440m | 3880m | 4310m | 3.45 |
| 15 | 400m | 800m | 1200m | 1600m | 2000m | 2400m | 2800m | 3200m | 3600m | 4000m | 4.00 |
| 14 | 373m | 746m | 1120m | 1488m | 1860m | 2240m | 2600m | 3000m | 3360m | 3733m | 4.15 |
| 13 | 350m | 700m | 1050m | 1400m | 1750m | 2100m | 2450m | 2800m | 3150m | 3500m | 4.35 |
| 12 | 320m | 640m | 960m | 1280m | 1600m | 1920m | 2240m | 2560m | 2880m | 3200m | 5.00 |
| 11 | 290m | 600m | 890m | 1170m | 1480m | 1770m | 2000m | 2320m | 2600m | 2900m | 5.30 |
| 10 | 266m | 533m | 800m | 1064m | 1330m | 1600m | 1860m | 2140m | 2400m | 2660m | 6.00 |
| 9 | 250m | 480m | 720m | 960m | 1200m | 1440m | 1680m | 1920m | 2160m | 2400m | 6.40 |
| 8 | 214m | 426m | 640m | 853m | 1064m | 1280m | 1488m | 1711m | 1920m | 2140m | 7.30 |
| 7.5 | 200m | 400m | 600m | 800m | 1000m | 1200m | 1400m | 1600m | 1800m | 2000m | 8.00 |
| 7 | 186m | 373m | 560m | 746m | 931m | 1120m | 1330m | 1488m | 1680m | 1860m | 8.30 |
| 6 | 160m | 320m | 480m | 640m | 800m | 960m | 1120m | 1280m | 1440m | 1600m | 10.00 |
| 5 | 133m | 266m | 400m | 533m | 665m | 800m | 931m | 1064m | 1200m | 1330m | 12.00 |
| 4 | 106m | 214m | 320m | 426m | 533m | 640m | 746m | 853m | 960m | 1064m | 15.00 |
| 3 | 80m | 150m | 240m | 320m | 400m | 480m | 560m | 640m | 720m | 800m | 20.00 |
| 2 | 53m | 106m | 160m | 214m | 266m | 320m | 373m | 426m | 480m | 533m | 30.00 |
| 1 | 26m | 53m | 80m | 106m | 133m | 160m | 186m | 214m | 240m | 266m | 60.00 |
| Time | 1 | 2 | 3 | 4 | 5 | 6 | 7 | 8 | 9 | 10 | |

46

42

FIG. 1D

PORTABLE DEVICE FOR WEIGHT LOSS AND IMPROVING PHYSICAL FITNESS AND METHOD THEREFOR

RELATED APPLICATION

This is a continuation-in-part of U.S. patent application Ser. No. 11/058,703, filed Feb. 15, 2005, now abandoned which is hereby fully incorporated by reference herein.

BACKGROUND OF THE INVENTION

1. Field of the Invention

The present invention relates generally to measurement devices for measuring and improving the physical fitness of a person, and a method therefor, and more particularly, to a method, system, and software embodied in a portable measurement device having wireless positioning technology.

2. Description of the Related Art

Good health and physical fitness go hand-in-hand. Numerous exercise books and diet programs have been promoted throughout the years to assist persons desiring to improve their physical fitness. Some involve complex formulas which take into account countless variables including percent body fat or bodily dimensions such as the circumference of the waist, arms and legs. Others involve eating and exercise regimens having point systems designed to limit a person's caloric or carbohydrate intake, or balance the consumption of certain food groups. Others involve measuring fitness based on the volume of oxygen consumed while exercising at maximum capacity (sometimes referred to as VO2 max), and then creating exercise workouts that raise the heart rate to between sixty-five and eighty-five per cent of its maximum for at least 20 minutes three to five times a week. Yet others involve a mix of weight training, aerobic exercise and proper diet. Few work, and fewer still are simple to use and easy to implement without the use of elaborate equipment, tedious measurements or complex tables. There is a need for a system to improve a person's physical fitness level that works for all body types. There is a need for a method to improve the physical fitness of a person, which method is easy to use and can be implemented without the need for expensive or specialized equipment, a trip to a gymnasium, or complicated measurements. There is also a need for a standardized method of measuring the physical fitness level of a person. Similarly, there is also a need for a standardized system to measure and provide exercise workouts that allow a person to improve from one fitness level to another.

Portable, electronic navigation devices employing global positioning systems ("GPS") receivers are well known. In addition, portable devices that include other means of determining location such as dead reckoning are also known in the art. Generally, GPS is a satellite-based radio-wave navigation system that allows a receiver device to calculate geographic location or position based upon triangulation. A plurality of satellites orbit about the Earth in extremely precise orbits. The GPS satellites relay their location down to Earth and any number of receivers. The GPS receiver devices receive spread spectrum GPS satellite signals from these various satellites. These signals are continuously transmitted from each satellite at a highly accurate frequency standard. Each satellite, as part of its signal transmission, transmits information indicative of that particular satellite. Using GPS satellite signals from at least three satellites, the receiver triangulates a two dimensional geographic location. Acquisition of an additional fourth satellite signal allows the GPS receiver device to calculate its three-dimensional position. In this manner, an electronic navigation device employing a GPS receiver accurately computes the position of the device almost instantaneously. U.S. Pat. No. 6,132,391 to Onari, et al., discloses a portable position detector that utilizes GPS technology and includes additional background on the operation of portable electronic devices incorporating GPS.

Recent advances in low power consuming electronics as well as the miniaturization of electronics have created a market for hand-held pedometers capable of determining geographic positioning. However, portable pedometers that solely rely on GPS for position information are restricted in their usefulness by buildings, tall structures and very rugged terrain that block satellite signals from reaching the receiver device. U.S. Pat. No. 6,850,844 to Walters, et al., discloses a portable navigation device with integrated GPS and dead reckoning capabilities. Such devices are particularly useful in metropolitan areas where tall buildings and other structures create barriers to reception of satellite signals.

In addition to GPS, the geographic position of a receiving unit may be determined using radio waves from localized sources such as cellular towers or any customized transmitting radio frequency towers deployed and combined in groups of three or more. A standard geometric triangulation algorithm can be used to determine an approximate location of the receiving unit by employing such localized radio wave sources. Finally, other methods have been integrated into portable positioning devices in order to fill in gaps when GPS or other radio wave-dependent systems temporarily fail because of a loss of signal reception. For example, some devices incorporate a variety of sensors, such as speed sensors, accelerometers, or direction sensors such as gyroscopes. Some such pedometers calculate distance by multiplying the number of steps by the length of a step. Based on the calculated distance and the direction measured with a direction sensor, the location of a walker is determined.

OBJECTS OF THE INVENTION

The following section of the written description describes some of the objects of the present invention, but the section is not exhaustive of all of invention's objects.

It is an object of the present invention to provide a system to measure the baseline physical fitness level of a person and determine timed physical fitness routines to maintain or improve the physical fitness level of that person based upon that person's fitness level.

It is a further object of the present invention to provide a method for improving the physical fitness of a person by measuring that person's fitness level and prescribing a group of simple exercise routines based upon that fitness level.

It is another object of the present invention to prescribe a group of exercise regimens based upon a person's fitness level wherein each exercise regimen represents at least one timed exercise routine comprising of walking or running.

It is yet another object of the present invention to provide a process of measuring a person's fitness level based upon that person's maximum performance level while walking or running for a predetermined period of time not exceeding ten minutes, and providing a choice of five exercise regimens comprising exercise routines of varying repetition, each routine within an exercise regimen requiring no more than ten minutes of continuous walking or running at one time.

It is yet another object of the present invention to embody the system and method of measuring and improving the physical fitness level of a person in a portable electronic apparatus.

It is a further object of the present invention to embody the system and method of the present invention in a portable device capable of measuring the distance traveled by the person.

It is yet another object of the present invention to provide an embodiment that includes a portable device capable of measuring the distance traveled by the person using wireless location positioning technology.

SUMMARY OF THE INVENTION

Briefly described, and in accordance with a preferred embodiment thereof, the present invention relates to a portable, electronic fitness training device that comprises a memory adapted to store user entered data and an operating program; a user interface adapted to enable a user to enter data into the memory; a display adapted to display information to the user; and a location signal receiver adapted to receive location signals from a plurality of sources external to the fitness training device. The portable, electronic fitness training device also comprises a command and control circuit coupled to the memory, to the user interface, to the display and to the location signal receiver. The command and control circuit is capable of executing the program, performing mathematical calculations and generating control signals based upon the user entered data and the location signals from the location signal receiver. The portable, electronic fitness training device is adapted to prompt the user to begin an exercise routine. The portable, electronic fitness training device is capable of determining the distance traveled by the device during an exercise routine based upon the location signals, thereby determining a fitness level of the person upon completion of the exercise routine. The program determines a plurality of timed exercise regimens based upon the fitness level.

Another aspect of the present invention relates to a method for improving the physical fitness of a person, comprising the following steps: Supplying the person with a portable electronic fitness training device capable of receiving location positioning signals. Obtaining from the fitness training device a distance traveled by the person upon the person performing one exercise routine from a group of exercise routines at substantially the person's maximum performance. Calculating a fitness level of the person after the person completes the one exercise routine based upon two performance variables from the variables consisting of time, speed and distance. Identifying a plurality of exercise regimens based upon the fitness level. Providing the plurality of exercise regimens to the person via the fitness training device. Each of the exercise regimens comprises at least one exercise routine of a predetermined period of time.

A further aspect of the invention relates to a method for improving the physical fitness of a person comprising the steps of: obtaining location information about the person as the person travels afoot at substantially the person's maximum performance level for a period of time up to ten minutes in duration; measuring two performance variables from the variables consisting of time, speed and distance as the person completes the traveling of the obtaining step; assessing a fitness level of the person from a predetermined range of fitness levels based upon the measured performance variables from the measuring step; determining a plurality of timed exercise regimens for the person based upon the assessed fitness level; and providing to the person one or more of the plurality of timed exercise regimens. Each exercise regimen comprises of at least one exercise routine from a group of exercise routines comprising of a walking routine and a running routine.

Underlying and integral to the portable, electronic fitness training device of the present invention is a simple system and method to measure and improve the physical fitness of a person. The system integral to the present invention incorporates years of experience in fitness training and the results of years of testing athletes as well as non-athletes in efficient exercise routines to maintain or improve the fitness level of a person. The present invention provides a standardized method of measuring and improving the physical fitness of a person. One embodiment of the present invention incorporates the aforementioned standardized method of measuring and improving the physical fitness of a person into a portable pedometer device.

Briefly, the present invention provides a portable device and method for ascertaining and improving the physical fitness of a person wherein the person performs at least one exercise routine comprising of walking or running to determine that person's then existing physical fitness level. Based on that fitness level, the present invention prescribes a variety of timed exercise routines comprising of walking or running for that person to perform. The timed fitness routines typically vary from one minute to ten minutes in duration, and may vary in number of repetitions. The timed exercise routines are organized into regimens. In order to measure the person's fitness level, the person must conduct a fitness test during which any two performance variables from the variables consisting of time, speed and distance are measured. The person should perform the fitness test at substantially that person's maximum performance level for a period of time within a predetermined range of time periods, typically between one minute and ten minutes.

Based on the person's maximum performance during the fitness test stage, the method determines and prescribes a group of exercise regimens. Each exercise regimen consists of at least one timed exercise routine from a predetermined variety of exercise routines. Depending upon the fitness level of the person, the exercise routines may include walking, walking fast and/or running. The person then selects one exercise regimen from the group and performs that selected exercise regimen. In the preferred embodiment, no single exercise routine within an exercise regimen lasts longer than ten minutes in duration. Thus, the longest, 10-minute fitness routine is performed once within an exercise regimen. The exercise routines of shorter duration should be repeated several times, increasing in number as the duration of the exercise routine becomes shorter. Accordingly, depending on the selected routine, the person completes at least ten minutes exercise in a training session. The exercise regimens also include rest intervals between each fitness routine as applicable. Hence, an exercise regimen calling for five runs each lasting five minutes also prescribes a 5-minute rest interval between each of the five runs. The method for improving the fitness level of a person includes performance of the predetermined exercise regimen on a regular basis, depending upon the current fitness level of that person and how quickly or aggressively that person seeks to improve his or her fitness level. By repeating and varying which of the predetermined exercise regimens is performed, the person masters a particular fitness level and eventually becomes capable of performing at the next higher fitness level. According to the method of the present invention, a person should performs a predetermined exercise regimen exercise no more than twice a day. Ideally, the person performing the exercise regimens varies the workouts such that same exercise regimen is not performed sequentially. The number of fitness levels is predetermined. That is, in one embodiment there are twenty-one fitness levels beginning with level one and ending at level twenty and including an interim level between level seven and eight. In this exemplary, fitness level one is representative of a beginner and level twenty is representative of a world-class athlete.

The present invention may be embodied in a portable, electronic device having wireless location or positioning technology. The portable device may be hand-held, designed to be strapped to apparel or shoes, or may be designed to be worn around the arm, wrist, ankle or neck. The device includes a memory for storing user entered data, an operating program and a plurality of user prompts for the operating program. The device also includes a user interface to enable a user to enter data into the memory, and a display to visually display information to the user. The user interface may be a keyboard, but other suitable inputs may be utilized allowing the user to entered pertinent information into the memory. The device also includes a display to communicate information to the user and a location signal receiver adapted to receive location signals from a plurality of sources external to the fitness training device.

A processor or command and control circuit is coupled to the memory, the user interface, the display and the location signal receiver. The processor or command and control circuit is capable of executing the program, performing mathematical calculations, and generating control signals based upon the user entered data and the location signals from the location signal receiver. The fitness training device prompts the user to begin an exercise routine. Upon commencement of the exercise routine, the device monitors and tracks the distance traveled by the device (and hence its user) throughout the performance of the exercise routine based upon the location signals and uses such information to determine the fitness level of the person upon completion of the exercise routine. Using the measured performance, the program determines a plurality of timed exercise regimens based upon the calculated fitness level.

BRIEF DESCRIPTION OF THE DRAWINGS

The subject matter that is regarded as the invention is particularly pointed out and distinctly claimed in the claims at the conclusion of the specification. The foregoing, and other objects, features, and advantages of the present invention are shown and described in the following detailed description of the preferred embodiments, which should be viewed in conjunction with the accompanying drawings in which:

FIG. 1B is a more detailed view of the slide rule of FIG. 1A showing details of a table with a slide superimposed atop the table;

FIG. 1C is a more detailed view of a complementary part of the table of FIG. 1B;

FIG. 1D illustrates another embodiment of the table of the present invention;

DETAILED DESCRIPTION OF THE PREFERRED EMBODIMENTS

Figure 1A:
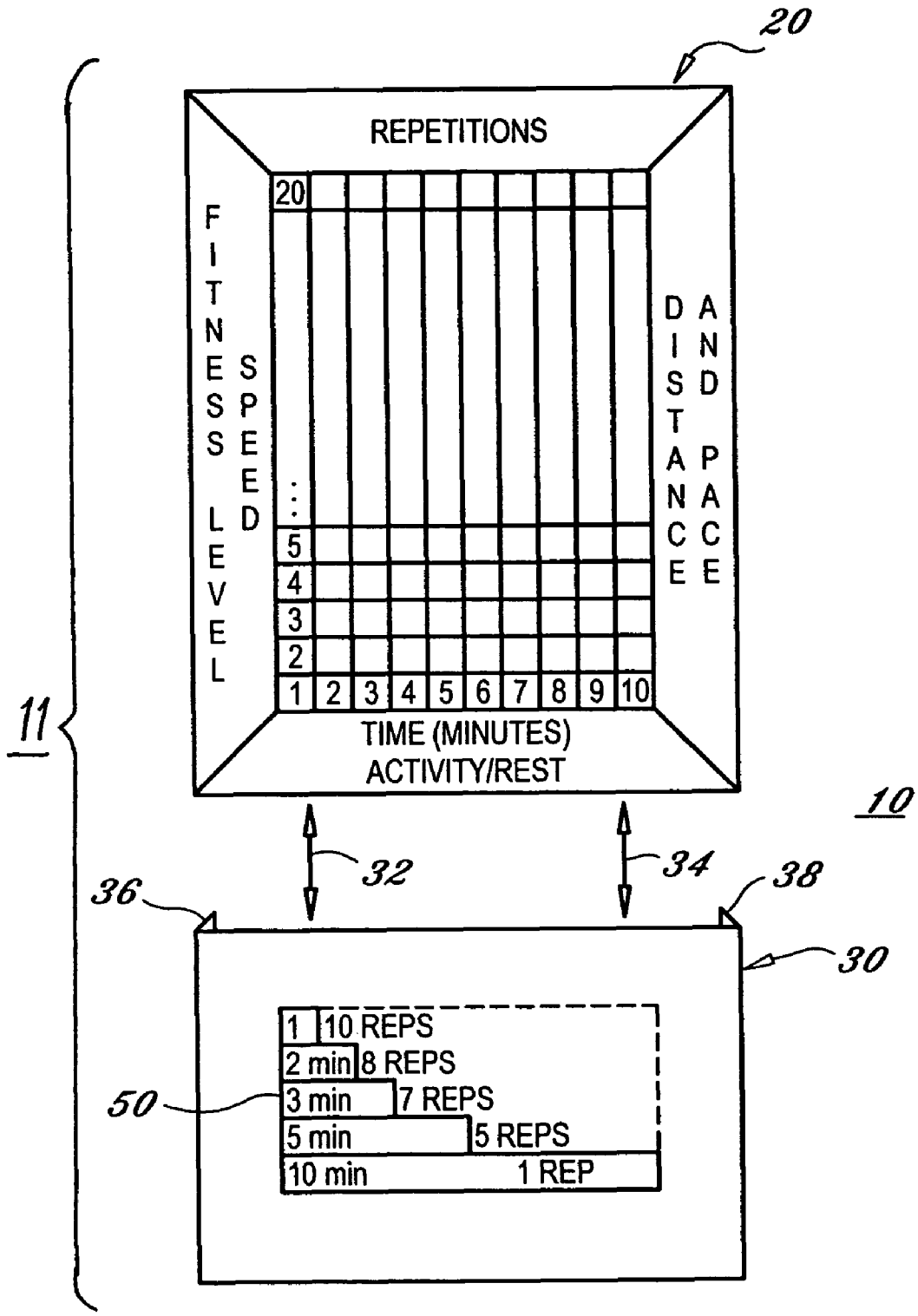
FIG. 1A is a plan view of a slide rule in accordance with the present invention.

The present invention relates to a system for improving the physical fitness of a person, thereby reducing excess body fat resulting in long-term weight loss, and a method therefore. More particularly, the invention relates to a method, system, and software for ascertaining the physical fitness level of a person and devising exercise routines to improve the fitness level of a person based upon that fitness level. The method of the present invention may be embodied in numerous systems. It is important to note that the embodiments of the invention described below are only examples of some of the uses of the teachings described herein. In general, statements made in the specification do not limit any of the various claimed inventions. Moreover, some statements may apply to some inventive features but not to others. Unless otherwise indicated, singular elements may be in the plural and vice versa with no loss of generality. Similar reference numerals and letters represent similar components and system features throughout the drawings and the written description.

A slide rule system including a descriptive chart and slide is diagrammatically illustrated in FIGS. 1A-1D. FIG. 1A diagrammatically illustrates a slide rule 11 for determining a person's fitness level and for determining timed fitness training routines from a predetermined variety of walking or running routines to be performed. The fitness system 10 of the present invention is explained in the chart 20 that is used in conjunction with slide 30. Arrows 32, 34 indicate that chart 20 slides within slide 30. In the illustrated embodiment, slide 30 is constructed of a transparent material such that the user is able to read the information on chart 20 through the slide 30. Accordingly, the slide 30 provides a frame or window 50 that when placed at the proper location on chart 20 provides information on the user's fitness level and on a variety of fitness routines to be performed by the user commensurate with the user's fitness level. When properly applied by a user, the fitness system 10, embodied in the chart 20 and slide 30, enables the user to improve his or her physical fitness level and thereby reduce the quantity of excess bodily fat in the process. Through continuous use of the system 10 over a period of time, that user will experience weight loss attributed to loss of excess bodily fat.

FIG. 1B diagrammatically illustrates part of chart 20 showing fitness levels one through ten along the left-most column 40. In the illustrated embodiment, chart 20 includes twenty-one fitness levels (chart 20 continues in FIG. 1C). More fitness levels may be utilized to provide additional steps for the person using the chart to reach a particular goal or fitness level. For example, the embodiment illustrated in FIG. 1B includes level 7.5 between levels seven and eight, and additional levels may be added halfway between any of the fitness levels on chart 20. Studies have shown that the jump from fitness level seven to eight is significant. Accordingly, an intermediate level 7.5 has been added to chart 20 to encourage users reaching level seven to continue training to reach level 7.5. Fitness level one, shown at the bottom, left corner of the chart 20 is indicative of the least fit level and fitness level twenty the most fit level (FIG. 1C). Other nomenclature or symbols—other than numbers one through twenty—may be used to indicate the fitness level. For example, the fitness level may be indicated by a color coded series of bars as is used to indicate higher levels of performance or mastery in martial arts. For the practical purpose of illustration, chart 20 has been divided between FIGS. 1B and 1C. However, in one embodiment, chart 20 includes all twenty-one fitness levels (see FIG. 1D). In the embodiments of the charts of FIGS. 1B through 1D, in addition to indicating a particular fitness level, column 40 also corresponds to the speed in miles per hour at which a person is walking or running when the person performs an exercise routine falling within the row corresponding to that fitness level.

In accordance with data shown in chart 20 (FIGS. 1B, 1C and 1D), fitness levels 15 through 20 are indicative of persons at fitness levels on par with that of world-class athletes. Levels 11 through 14 indicate a fitness level of athletes generally, and levels one through ten are representative of beginners through intermediate stages, respectively. The fitness system 10 of the present invention may be further divided into sections having multiple levels such that the charts are provided to the user as that person reaches higher levels of fitness. For example, chart 20 may be divided into three categories representative of a beginner to intermediate stage, an athletic stage and a world-class athlete stage. As a person matures from a beginner stage to a higher stage, a new chart is introduced. By promoting use of the fitness system 10 in stages, a person at one of the beginning fitness levels is not discouraged by perceiving the need to reach the fitness level of a world-class athlete and can set his or her goal at a more realistic expectation of reaching the top of that particular intermediate stage.

In FIGS. 1B, 1C and 1D, chart 20 includes ten columns representing time in minutes increasing from one minute to ten minutes, from left to right (see bottom row), and the number of repetitions decreasing from ten to one (see top row), from left to right. The bottom, time row 42 is numbered one to ten. The top, repetitions row 44 is numbered from ten to one. The time row-42 is used to describe the duration of a workout routine and, when applicable, the duration of the rest interval between each repetition of an exercise routine. Chart 20 also includes a "minutes per mile" column 46 at the right side of the chart 20. As the fitness levels increase from one to twenty, the minutes per mile figure decreases correspondingly. Hence, in FIG. 1B, a person performing at fitness level ten (the top row) is running at a six minute-per-mile pace.

The charts illustrated in FIGS. 1B-1D include cells having four sets of data. Each cell within chart 20 includes fitness level, speed, distance and time information. For example, in FIG. 1B, cell 48 includes 266 m, indicating 266 meters, 2/5, indicating fitness level 2 (or two miles per hour) at five minutes, and 0.16M, indicating 0.16 miles. As can be readily appreciated, other than the distance information, the individual cells of the charts illustrated in FIGS. 1B-1C provide information determinable by cross-referencing the numerals that label the bottom row and left column. For example, in cell 48, the 2/5 numbers are ascertainable by noting that the "2" corresponds to the second row, the fitness level along the left-most column 40, and the "5" corresponds to time column 5, the minutes along the bottom time row 42. Finally, although chart 20 provides distance in both meters and miles, the chart need not include such information as the distance may be calculated by cross-referencing the speed and time. Additionally, the data contained within chart 20 may be expressed in other units of measure. Hence, for example, the distance may be provided in yards instead of miles and meters. FIG. 1D illustrates a simple embodiment of chart 20 including distance measured in meters.

The information contained within each element of chart 20 need not be reproduced in the element, because the information may be ascertained by cross-referencing the data in time row 42 and the miles-per-hour column 40. Other embodiments of chart 20 do not include such data within the cells of the chart 20. For example, in one embodiment, chart 20 only includes fitness level data in the chart's cells. This embodiment would be particularly useful in connection with treadmills that are adjustable to operate at a particular speed for a predetermined period of time. As will be readily understood from the explanation regarding use of the present invention below, because the fitness level corresponds to the speed in the illustrated embodiment, the user may adjust the speed of the treadmill to the correct level and then perform the prescribed workout routine. Accordingly, the additional information contained in the elements of chart 20 of the embodiments illustrated in FIGS. 1B and 1C are for ease of use.

FIGS. 1A and 1B include a slide 30. In the embodiment illustrated in FIGS. 1A and 1B, slide 30 is constructed of a transparent material that allows the user to see the information on chart 20 through the slide. Slide 30 provides a window-like frame 50 that is adapted to slide over all ten time columns of chart 20. FIGS. 1A and 1B illustrate the use of flaps 36, 38 that serve to capture chart 20 such that the left and right borders of frame 50 align with the outer boundaries of columns one and ten of chart 20. The embodiment illustrated in FIGS. 1A and 1B is but one of several designs that can be implemented to construct the slide rule 11 as will be appreciated by those of ordinary skill in the art. Frame 50 of slide 30 includes five rows having dimensions corresponding to the rows of chart 20. Frame 50 is further defined by a step-like line that divides the frame in a diagonal fashion defining two regions 60, 70. Active region 60, the lower left side of slide 30, includes areas 62, 64, 66, 68 and 69. The right-most part of each row of active region 60 is used to measure the fitness level of a person and to determine one or more timed fitness routines. Defining region 70, the upper right side of slide 30, includes areas 74, 76, 78 and 79. In some instances, as explained below, defining region 70 helps in the measurement of a person's fitness level.

The active region 60 is marked to indicate that the bottom row of the region, or area 62, represents a workout routine of a single repetition lasting ten minutes. The row above, area 64, represents a workout routine lasting five minutes that should be repeated up to five times. Area 66, the middle row, represents a 3-minute workout routine that should be repeated up to seven times. Area 68 represents a 2-minute workout to be repeated up to eight times. Area 69 defines a 1-cell sized area representing a 1-minute workout to be repeated up to ten times. In order to ease understanding the present invention, a workout routine or exercise routine is defined as a single walking or running event lasting a predetermined amount of time. An exercise regimen is defined as at least one exercise routine or workout routine. Hence, by way of example, an exercise regimen may be defined by eight workout routines lasting two minutes each with a rest interval of two minutes between each routine, or may be defined by a single exercise routine lasting ten minutes. The workout table below lists five regimens consisting of timed workout routines used in conjunction with the embodiment of the present invention illustrated in FIGS. 1A-1D:

| Timed Exercise Regimens | | |
|---|---|---|
| Workout Time (minutes) | Repetition(s) | Rest Interval (minutes) |
| 1 | 10 | 1 |
| 2 | 8 | 2 |
| 3 | 7 | 3 |
| 5 | 5 | 5 |
| 10 | 1 | — |

The timed exercise regimens above have been found to be effective in improving the physical fitness of a person. Moreover, the simple breakdown of the regimens into timed exercise routines of rounded incremental values makes this embodiment of the system and method of the present invention easy to use. More sophisticated embodiments of the present invention, for example, as used in a programmable treadmill or in a computer based application, may divide the exercise routines into different or further incremental values within the 10-minute range. For example, the routines may be defined by durations increasing from one minute to ten minutes in increments of ten, twenty or thirty seconds. The present invention may also include workout routines longer in duration. However, in the preferred embodiment, no single workout routine exceeds ten minutes in duration. Experience indicates that the exercise regimens organized in the charts of FIGS. 1B through 1D are effective in maintaining and increasing the fitness level of a person, depending upon how often the exercise regimens are performed by the end user. Moreover, as a person increases in fitness level, that person experiences a reduction in excess bodily fat. The 10-minute maximum duration for any one exercise routine also entices many to participate in an exercise program involving walking or running that they would otherwise have no interest in implementing for themselves.

The fitness system 10 of the present invention works as follows. A person must first test and measure his or her current fitness level. In order to test and measure a person's fitness level, the person must walk or run at substantially the maximum of that person's ability for a duration of time between one minute and ten minutes. The person may walk or run on a measured track or a treadmill that tracks distance. Ideally, the person performs the test walk or run as fast as the person can for a minimum of one minute up to a maximum of ten minutes. It is not critical that the test walk or run be at the person's absolute maximum potential, because the object of the test is to place the person's fitness level within the chart 20 in order to determine exercise regimens and begin the process of improving the physical fitness of the person. Moreover, each fitness level within chart 20 has a range such that even if a person does not perform at his or her absolute maximum, such person is likely to accurately determine his or her fitness level. Finally, the performance of future exercise regimens or their component workout routines provides additional opportunities to re-test and reassess the person's fitness level.

During the test walk, run or combination of walking and running, measurements of time and speed, time and distance, or speed and distance should be noted. Using these measurements, a person can find a cell on chart 20 that most closely matches the tested effort. By way of example, suppose that a person who walks at substantially that person's maximum performance level for a total of five minutes is able to travel 266 meters, approximately equivalent to ⅔ lap around a standard track of approximately 400 meters, a distance covering 0.16 miles. Using chart 20, the person finds the 5-minute column from the time row 42. Working his or her way up column 5, the cells progress from a distance of 133 meters for the first row, 266 meters for the second row, 400 meters for the third row and so on. Hence, the test walk is represented by cell 48 (the second row of the $5^{th}$ column). Notably, this person could have reached the same cell knowing that he or she was walking at a 2 miles/hour pace for a total of five minutes. Also note that if the person had pushed himself or herself harder and been able to complete ¾ of a lap or 300 meters instead of 266 meters, that person would still be at the same cell within chart 20, cell 48. Hence, using two performance variables from the group of time, speed and distance, a person is able to find the cell on chart 20 that most closely matches the person's maximum performance.

Next, using slide 30, the person slides frame 50 up chart 20 until the test cell falls within the right-most cell of the active region 60. In the example, cell 48 aligns with the right-most cell of the second row 64 of active region 60 within frame 50. In FIG. 1B, frame 50 of slide 30 is represented in bold on chart 20. Hence, in the exemplary test, the top of frame 50 aligns with the top of row 5, corresponding to fitness level 5, and the bottom of frame 50 aligns with the bottom of chart 20. The alignment of the top row 69 of frame 50 determines the fitness level of the person. Under the example, this person is at fitness level 5. Note that had the same person walked ⅕ of a mile or 0.20 miles in six minutes, he or she would have tested at 2/6 and still be at the same fitness level—level 5. This is because if the test cell does not align with the right-most cell of a row in the active region 60, then the person should slide frame 50 through chart 20 until a right-most part of active region 60 aligns as close to the left of the test cell as possible. Hence, a person who measures at cell 2/6 would align flame 50 as shown in bold in FIG. 1B such that cell 48 is directly to the left of the 2/6 test cell. The same holds true for test level 2/7, 2/8 and 2/9.

The fitness level measuring can be accomplished for any duration between one minute and ten minutes. If the test is conducted for one minute, then the slide 30 is aligned such that cell 69 (the top row of active region 60) fits directly over the test cell that most closely matches the person's performance. For the 1-minute test, the fitness level of the applicable test cell is that person's fitness level. Similarly, if the fitness level measuring procedure is conducted for ten minutes, the bottom right-most cell (the right-most cell of row 62) is fit over the test cell that most closely matches the person's performance. That person's fitness level is four levels above that row. Continuing with the previous example, had the person measured one hundred-thirty (130) meters over a 1-minute test, the 5/1 cell best aligns with the test results. Hence, such person would be at a fitness level 5. Had the same person walked for ten minutes and only been able to cover 300 meters, then he or she would test at the 1/10 cell. Placing the bottom right corner of slide 30 over the 1/10 cell reveals that the person is still at fitness level 5.

In order for this person to have tested at the next fitness level, he or she would have to be able to walk at three mph for a minimum of five minutes (test level 3/5). In general, a fitness test at a particular speed that lasts between five and nine minutes all result in the same fitness level. In other words, whether the person walks or runs at the same average pace for five, six, seven, eight or nine minutes does not matter because they all measure at the same level. The same holds true for the three and four minute tests.

Based upon a person's fitness level, the present fitness system 10 identifies a variety of timed exercise regimens, each consisting of at least one walking or running routine designed to help that person either maintain or increase the person's fitness level, depending upon how often the person performs the prescribed regimens. In accordance with the Timed Exercise Regimens table above, the embodiment illustrated in FIG. 1B identifies five exercise regimens having exercise routines of one, two, three, five and ten minutes in duration. Each row of the slide 30 defines an exercise regimen. In order to determine the various exercise regimens, the slide 30 is placed on the chart 20 such that the top, single cell 69 of the active region 60 is aligned with the person's fitness level. The user must look at the right-most cell of each row within the active region 60 to determine the details of the exercise routines making up that particular row's exercise regimen. For the top row, there is only one cell in region 60—cell 69. Hence, that cell defines a 1-minute exercise routine. The distance indicated in the cell shows the user the distance that should be traveled within a 1-minute walk or run. The next row 68 below includes two cells in active region 60. Using the right-most cell, the 2-minute exercise routine is determined. Using the same technique, the 3-minute, 5-minute and 10-minute exercise routines are determined. Notably, each exercise routine may be defined in terms of speed and time as well as distance and time.

In the example of the person at fitness level 5, the chart identifies the following timed exercise regimens:

| | | |
|---|---|---|
| 1 min. of fast walking for 133 meters or at 5 mph | 10 reps. | 1 min. rest between reps. |
| 2 mins. of fast walking for 214 meters or at 4 mph | 8 reps. | 2 mins. rest between reps. |
| 3 mins. of fast walking for 240 meters or at 3 mph | 7 reps. | 3 mins. rest between reps. |
| 5 mins. of fast walking for 266 meters or at 2 mph | 5 reps. | 5 mins. rest between reps. |
| 10 mins. of walking for 266 meters or at 1 mph | 1 rep. | May not be applicable. |

In FIG. 1B, the first exercise regimen is identified by cell 89 and consists of ten, 1-minute exercise routines. The second regimen is identified by cell 88, and consists of eight, 2-minute exercise routines. The third regimen is identified by cell 86, and consists of seven, 3-minute exercise routines. The fourth regimen is identified by cell 48, and consists of five, 5-minute exercise routines. The fifth regimen is identified by cell 82, and consists of one, 10-minute exercise routine. The level-5 person is to perform the timed exercise regimens outlined above. Depending on the fitness level of the person, if this person does one of the five prescribed exercise regimens daily, he or she will likely improve his or her physical fitness and thereby cause a reduction in excess bodily fat. As a person reaches the higher fitness levels, additional exercise regimens may have to be incorporated into that person's daily training to reach even higher fitness levels. The exercise regimens are designed to be performed a maximum of twice in one day, but can be performed more often with proper rest. Moreover, two regimens may be performed sequentially. Thus, for example, if a person performs the fifth regimen consisting of one, 10-minute routine, then that person would rest for 10-minutes, and then, ideally perform another regimen from the four unperformed regimens. If a person is simply trying to maintain a particular fitness level, the exercise regimens may be performed as little as 3 to 4 times a week, depending upon the athletic conditioning and the current fitness level of that person. A person desiring to maintain his or her fitness level at the higher levels may need to perform exercise regimens more often than those at the lower levels.

It is best to mix the particular exercise regimen from one performance to another. By way of example, if on one day the fitness level 5 person performs a exercise regimen consisting of ten repetitions of fast walking at five mph for one minute, with one minute intervals of rest between repetitions, then the next day that same person should choose to perform one of the other four remaining exercise regimens (two, three, five or ten minute exercise regimens). If a person seeks to improve his or her fitness level, then it is recommend that on any given day, that person combine the slower and faster exercise regimens (two workouts in one day). In addition to enhancing the system's effect on the person's fitness level, the mixing of exercise regimens has the added benefit of keeping the routines dynamic and challenging. Moreover, the human body adapts to performing the same routine repetitively, becoming efficient at performing at a particular level. By changing the exercise regimen at each workout, the system described in the present invention promotes improvement and prevents what some athletes refer to as reaching a "plateau" in his or her ability.

The predetermined exercise regimens from chart 20 never involve an exercise routine of walking or running more than ten minutes at a time. The exercise regimen defined by 1-minute workout routines takes approximately twenty (20) minutes to accomplish—ten repetitions of one minute each, plus a 1-minute rest interval between each repetition. The regimen defined by 2-minute workout routines takes approximately thirty-four (34) to thirty-six (36) minutes. The regimen defined by 3-minute workout routines takes approximately forty-five (45) to forty-eight (48) minutes. The regimen defined by 5-minute workout routines takes approximately fifty-five (55) minutes to one hour, and the regimen defined by a 10-minute workout routine lasts ten minutes because only one repetition is needed. Accordingly, the longest exercise regimen lasts approximately one hour, but no one exercise routine within a regimen lasts more than ten minutes.

The system 10 of the present invention may be used in a number of settings. Whether the person using the system prefers exercising outside or on a treadmill, the system 10 accommodates both. On a programmable treadmill, as described in greater detail below, maintaining the correct pace for a particular workout routine is accomplished through the treadmill. When applying the system to outdoor workouts, the right hand column of the chart, indicating pace (minutes/mile), helps monitor the workout routines of an exercise regimen. In the level 5 example, the person performing a particular exercise regimen on a treadmill can monitor his or her pace or simply program the treadmill to operate at the correct speed. If the same person walking outdoors is performing the five mph workout (1 minute), then the exercise regimen requires an exercise routine at a fast walking pace of 12 minutes per mile, or 3 minutes for each time around a standard ¼ mile track.

The exercise regimens (and their respective workout routines) determined by the slide 30 and chart 20 represent the recommended maximum number of repetitions. If the person is not able to reach the recommended maximum number of repetitions for the day, he or she should not be discouraged or change the regimen or its component workout routines. The system 10 was designed to be challenging. Because each person is different, a particular exercise regimen may be more difficult to complete than another. The key to succeeding and improving is to continue working toward that maximum number of repetitions.

The fitness system 10 of the present invention helps a person improve his or her fitness level. In order to determine whether a person has improved sufficient to train at the next fitness level, the person may re-test at any point. Walking or running at the person's maximum performance level for a time between one and ten minutes and measuring the speed or distance covered, and then following the previously described steps, the person can determine whether he or she is performing at a higher level. Another simple way to test whether a person is ready for the next level is to choose one of the person's four top workout speeds (the one, two, three or five minute workout routine speed), and then test whether he or she can walk or run a repetition at that speed for sufficient additional time to reach the next fitness level.

Figure 2A:
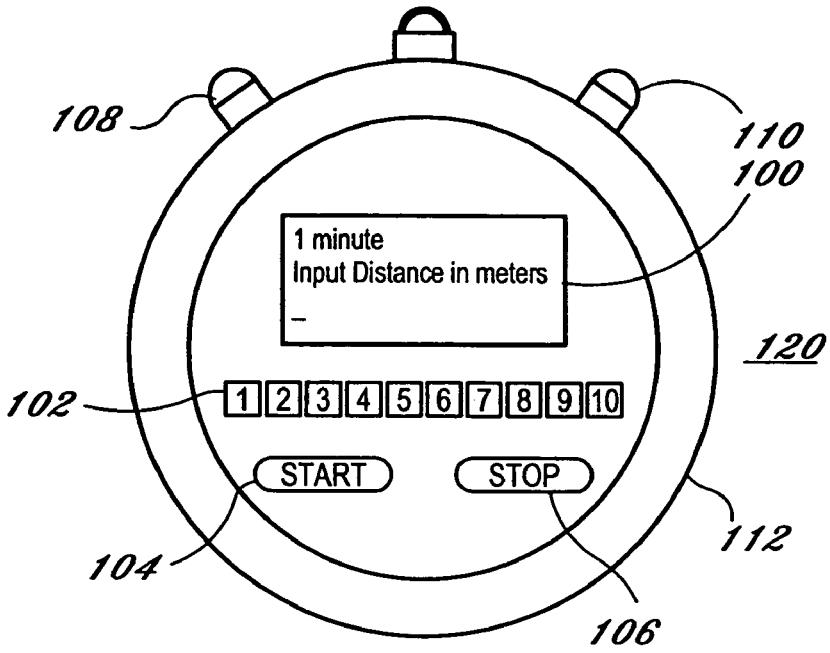
FIG. 2A diagrammatically illustrates a portable, electronic device in accordance with the present invention.
Figure 2B:
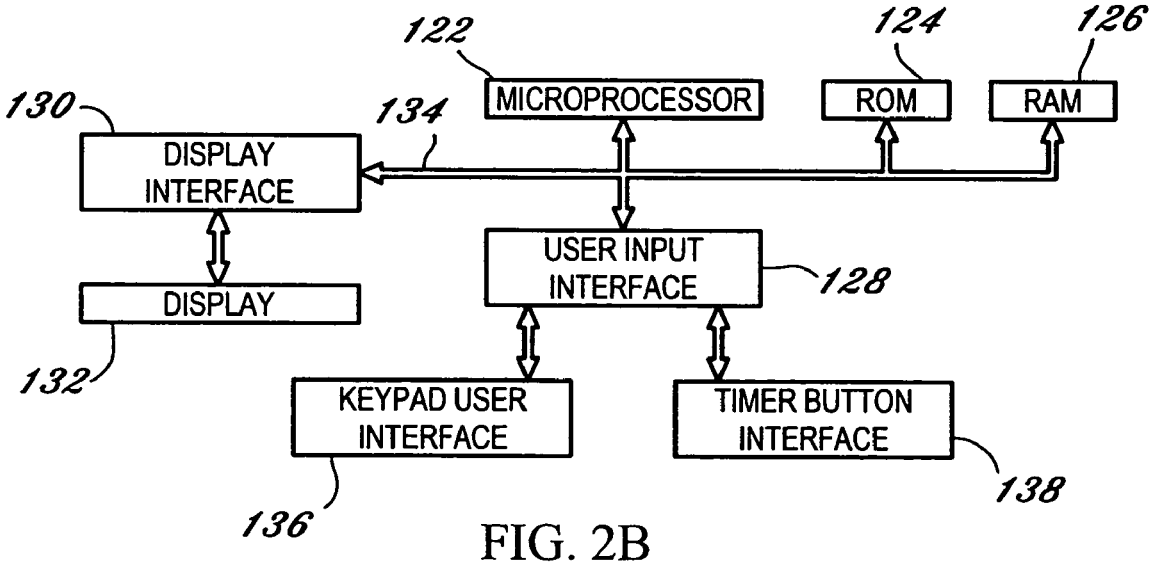
FIG. 2B is a block diagram illustrating the circuitry of the portable electronic device of FIG. 2A.
Figure 7:
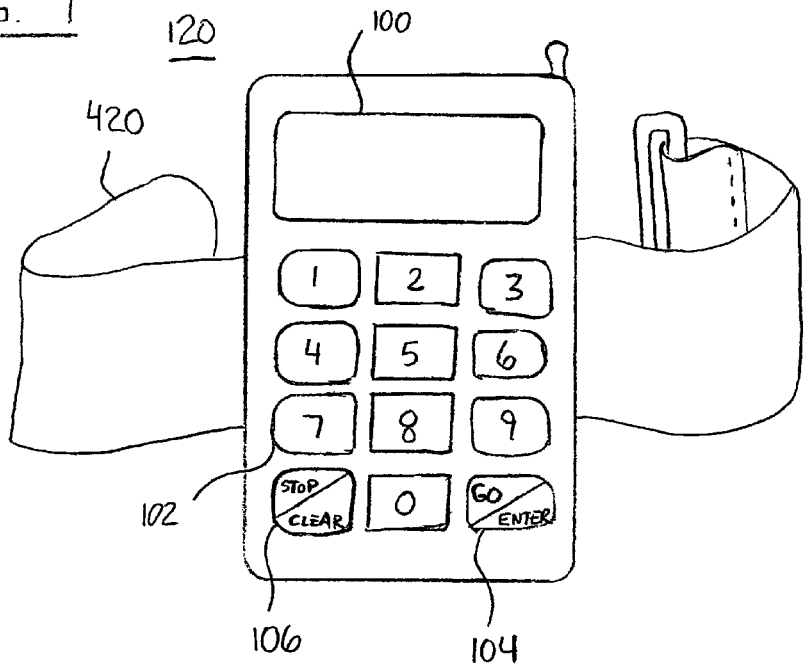
FIG. 7 diagrammatically illustrates a person exercising with the portable electronic device of the present invention having wireless positioning technology.

FIG. 2A diagrammatically illustrates a portable electronic device 120 for implementing the processes of the present invention. The portable device may be hand-held as illustrated in FIG. 2A or may be designed to be strapped to apparel or shoes, or may be designed to be worn around the arm, wrist, ankle or neck. FIG. 7 diagrammatically illustrates another embodiment of a portable device that includes a strap 420. The embodiment illustrated in FIG. 2A includes a display 100, user inputs 102, 104, 106, 108, 110, and a round-shaped exterior body 112. The exterior of the device may also use other shapes as illustrated in FIG. 7. The display can be a liquid crystal display, an alphanumeric display, or another like-display as is known in the art. The user input 102 is a keypad having numerals "1" through "10" to allow a user to input data for use of the present invention. Button 108 may be used to start and stop a timer, for example when used during an exercise routine. Button 110 may be used to reset a timer or to power the device on and off. FIG. 2B diagrammatically illustrates a block diagram illustrating one embodiment of the circuitry for the device. The circuitry for the fitness device 120 includes a microprocessor 122, a ROM 124, a RAM 126, a user input interface 128, a display interface 130 and a bus 134 that interconnects the components. The display interface 130 is coupled to the display 132 and may include a driver circuit. The driver circuit controls output at the display 100 in response to output from the microprocessor 122. The user input interface 128 is coupled to the keypad 136 and the timer buttons 138. The user input interface 128 detects inputs from the keypad 102 and from the timer buttons 138 and notifies the microprocessor of such inputs via bus 134. The ROM 124 stores the computer program that controls the operation of the microprocessor and includes the information contained in the chart and slide of FIGS. 1B through 1D and other constants necessary to calculate a person's fitness level and provide exercise routines for the user based on that fitness level. The RAM 126 stores data inputted by a user, the results of calculations, other information necessary for the operation of the system 120, and information regarding a particular user. RAM 126 is typically non-volatile or provided independent power so as to preserve the data contained therein.

Figure 6:
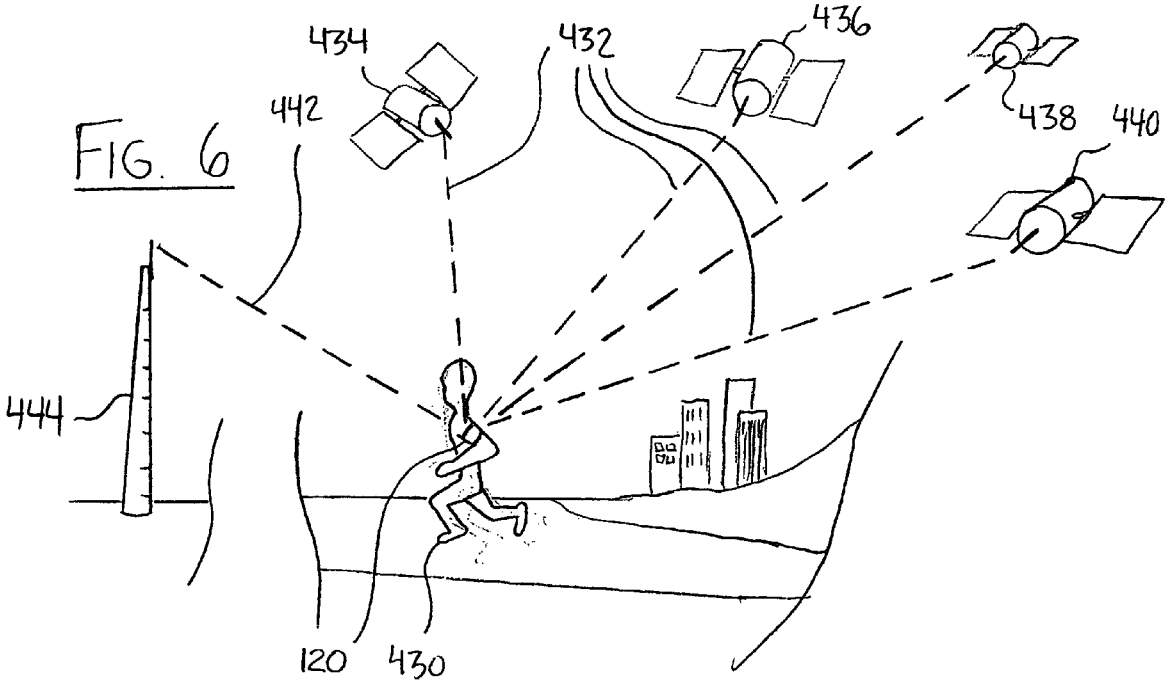
FIG. 6 diagrammatically illustrates an embodiment of the portable electronic device of the present invention having wireless positioning technology.

In an alternative embodiment, the portable electronic device 120 also includes a location signal receiver 410 that is coupled to bus 134 via a location signal receiver interface 412. The location signal receiver 410 may be a receiver or multiple receivers capable of receiving transmitted location information from either a global positioning system (GPS) or other location information system such as those known in the art. FIG. 6 diagrammatically illustrates a person 430 traveling afoot with the portable device 120 strapped to the person's arm. Dashed lines 432 represent transmission signals from satellites 434, 436, 438 and 440 typical in a GPS. Dashed line 442 represents a transmission signal from cellular tower 444. As more fully disclosed in U.S. Pat. Nos. 6,132,391 to Onari, et al., and 6,850,844 to Walters, et al., the teachings of which are incorporated herein by reference, devices, including pedometers, have been developed that are capable of using multiple location/positioning systems to determine the location of the device. For example, U.S. Pat. No. 6,850,844 to Walters, et al., discloses a portable navigation device with various integrated positioning systems. Furthermore, the system also stores cartographic data indicative of thoroughfares, includes a GPS receiver and a dead reckoning component. Using the information provided by these various systems, the device 120 of the present invention is capable of determining the distance traveled by the user carrying the device and the amount of time it took to cover that distance, information that might otherwise need to be manually inputted by the user. The portable electronic device 120 of the present invention may incorporate one or more of these technologies as part of the fitness system in order to facilitate the measuring and exercise regimens discussed herein.

Figure 2C:
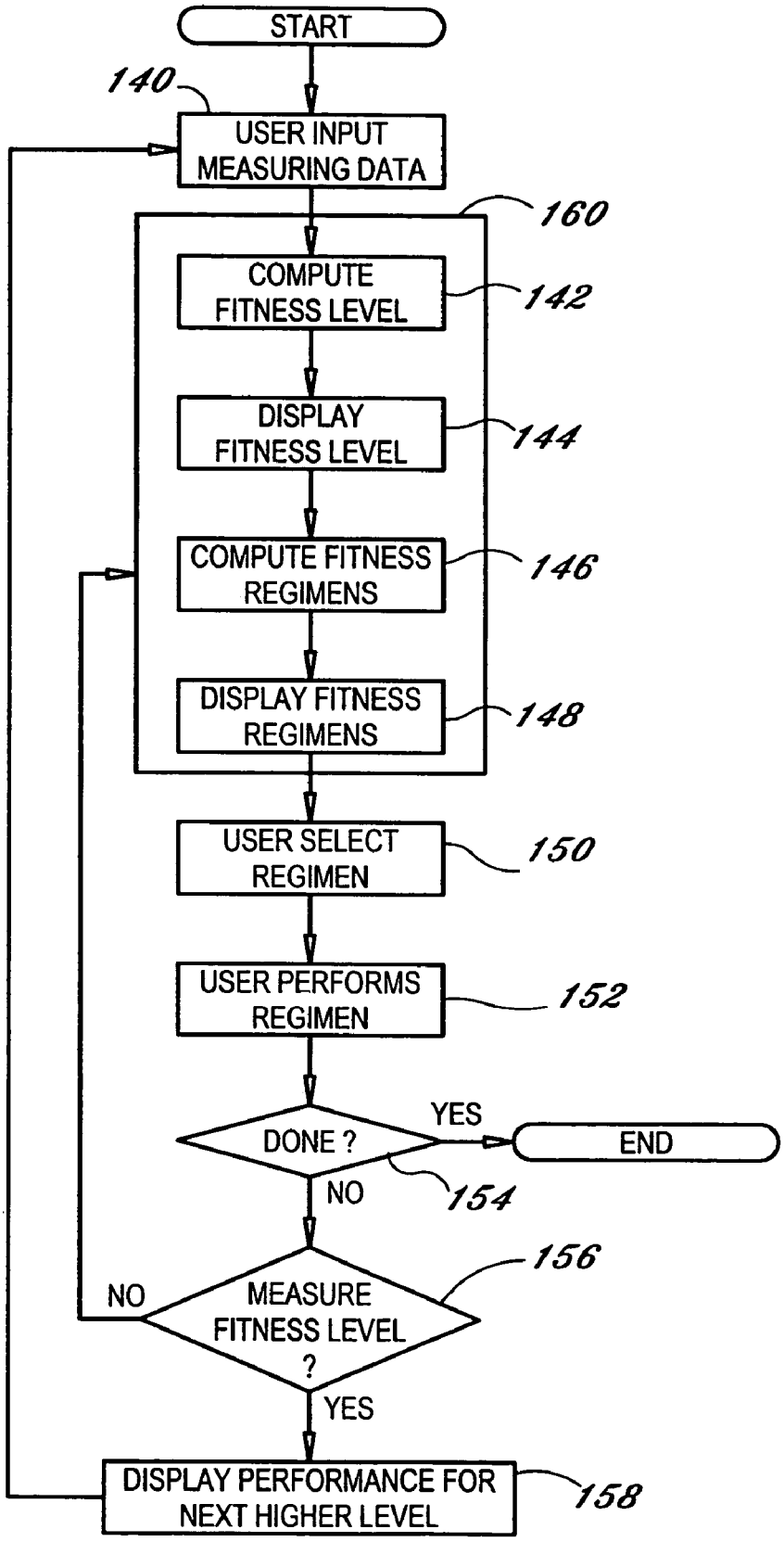
FIG. 2C is a flow diagram illustrating the operation of the system in accordance with the invention.

FIG. 2C is a flow diagram illustrating the operation of the electronic device 120 incorporating the present invention. For the sake of brevity, in the following description, the operation of the system of the present invention does not include the detail previously provided in connection with FIGS. 1B through 1D. A user can turn the device on by pressing button 110. In order to avoid accidental power loss, button 110 can be such that user input interface 128 only sends a power on or off control signal to microprocessor 122 if the button has been held down for a predetermined amount of time, for example, 3 seconds. Alternatively, for a power off mode, the program controlling processor 122 may have a routine that tests for the proper input from button 110 for a predetermined period of time at which the program terminates properly and shuts down the device. After powering up, in a simple program, the program displays a proper message giving the user notice that system is operable at step 140. The introductory part of the system may be modified to allow for use by more than one person. For example, after power up, the program can prompt the user through the display 132 to enter a user number "1" through "10" using keypad 102. If that user had used the device 120 in the past, that particular user's fitness level and/or previously performed exercise regimens could be displayed next. At step 140, the user is prompted to enter information regarding that user's performance during the measuring step. Alternatively, at step 140, the program may prompt the user to begin an exercise routine such that the program is utilized as a stop watch. At the end of performing an exercise routine, the user would press STOP to end the measuring period. Assuming that the user is inputting information about the last exercise routine, at step 140, the program prompts the user to select from an input of distance, speed and time. The user then selects one of the three using the keypad 102, after which the processor 120 determines which variable was selected and prompts the user to input that data using keypad 102. The inputted information is saved in RAM. The program then prompts the user to select another input from the two remaining performance variables. The user selects from among the two remaining variables and the program prompts the user to input that information using the keypad 102. That information is also stored in RAM. With two performance variables, the microprocessor computes the fitness level of the user at step 142. The microprocessor then sends the fitness level output to the display at 144. The program can either prompt the user to continue or simply display the information on a part of display 100.

In the alternative embodiment inclusive of the location signal receiver 410, the user may simply be prompted at step 140 to select from conducting a measuring exercise routine or conducting an exercise regimen. Either way, upon the user selecting to begin the particular activity, the device 120 begins to poll the location signal receiver 410 to obtain information regarding the position of the device 120 (and accordingly, the user holding the device). As the user performs the selected exercise routine and the device 120 obtains new position data, the program registers the changing position of the user, accumulating the total distance covered by the user. Notably, if the user was performing the exercise routine at a standard running track, his or her position would tend to repeat upon the user returning to previously traveled areas. The program advantageously tracks the cumulative distance traveled and not simply the difference between the start and stop locations. At the same time that the program is monitoring distance traveled, it also is measuring the passage of time. After the user completes the selected activity, the program uses the stored information to calculate speed and the user's fitness level.

The program is programmable to display both the fitness level and one or more of the five exercise regimens at once. Alternatively, it can display the fitness level, with a user prompt requesting the user to select an exercise regimen from among a one, two, three, five and ten minute regimen. The functional steps of computing the fitness level 142, displaying the fitness level 144, computing alternative exercise regimens 146 and displaying the fitness regimens 148 can be accomplished sequentially, or simultaneously, as represented by functional block 160. At step 150, the user selects from among the exercise regimens. The program saves this information in order to later prompt the user that he or she has already selected this exercise regimen if the user seeks another exercise regimen to perform. At step 152, the user performs the selected exercise regimen. Step 152 may be iterated during performance of the selected exercise regimen to account for each exercise routine within a particular regimen. Hence, the device 120 may display information regarding completion of exercise routines within the selected regimen so as to inform the user of his or her progress. Alternatively, the device 120 of the present embodiment may not include this step, as it will be performed by the user independent of the device. As a further enhancement or alternative, device 120 may include a program routine that is used to time the performance of the exercise routines and the rest intervals. For example, after selecting the exercise regimen, the program may prompt the user to press the START button 104 at the beginning of a particular routine within the regimen, and press the STOP button 106 at the end of the routine. For exercise regimens requiring repetition of exercise routines, the program may also include a timing sequence that prompts the user when the rest interval or period between routines is over. Accordingly, if a particular exercise regimen calls for five routines each lasting five minutes, the program prompts the user to begin the next exercise routine after a five-minute rest interval.

After the user performs the selected exercise regimen at step 152, the program prompts the user whether he or she is done at step 154. If YES, then the program terminates normally and shuts down the device. If NO, then the program prompts the user as to whether he or she will be re-measuring the fitness level at decision point 156. If NO, the program re-displays the exercise regimens applicable to the user's fitness level and prompts the user to select the next exercise regimen he or she is to perform. Again, although illustrated in the flow diagram as returning to block 160, the program may include instructions to display only the exercise regimens that have yet to be selected by the user, i.e., removing from the available regimens the previously completed regimens. This encourages the user to mix the exercise regimens performed for his or her fitness level.

If the user at decision block 156 decides to re-measure his or her fitness level, then the program may include instructions to display what performance must be achieved by the user to reach the next fitness level at step 158. This may be accomplished by the program prompting the user to select from among a measuring test lasting from one minute to ten minutes. Upon the user selecting the test time, the program can then display the speed at which the user must walk or run and the distance that must be covered to reach the next level. After displaying the performance required for the next level, the program may also include instructions similar for a regular exercise routine wherein the user is prompted to press START and STOP during the actual performance of the measuring step. The program then proceeds to prompt the user for the test information at step 140. If the user used device 120 to time the test-measuring walk or run, the program may prompt the user to input the distance covered during the walk or run. Utilizing the alternative embodiment with location positioning technology avoids the necessity of this step. As can be appreciated from the explanation of the exercise system of the present invention, using a programmable electronic device 120 allows greater flexibility in the testing and exercise regimens because the programming advantageously calculates the fitness level and proper exercise regimens. For example, if the user ran as hard as he or she could for 2½ minutes rather than a rounded 2 minutes or 3 minutes, upon inputting the distance covered (or upon determining same from location positioning systems), the program of the present device can calculate the speed at which the user walked or ran, and thus calculate the fitness level. The details regarding programming required for proper microprocessor recognition of inputs, and driver circuits for outputs are omitted for simplicity as these are known in the art. Similarly, the functions performed by the program may be accomplished through a command and control circuit.

Figure 3:
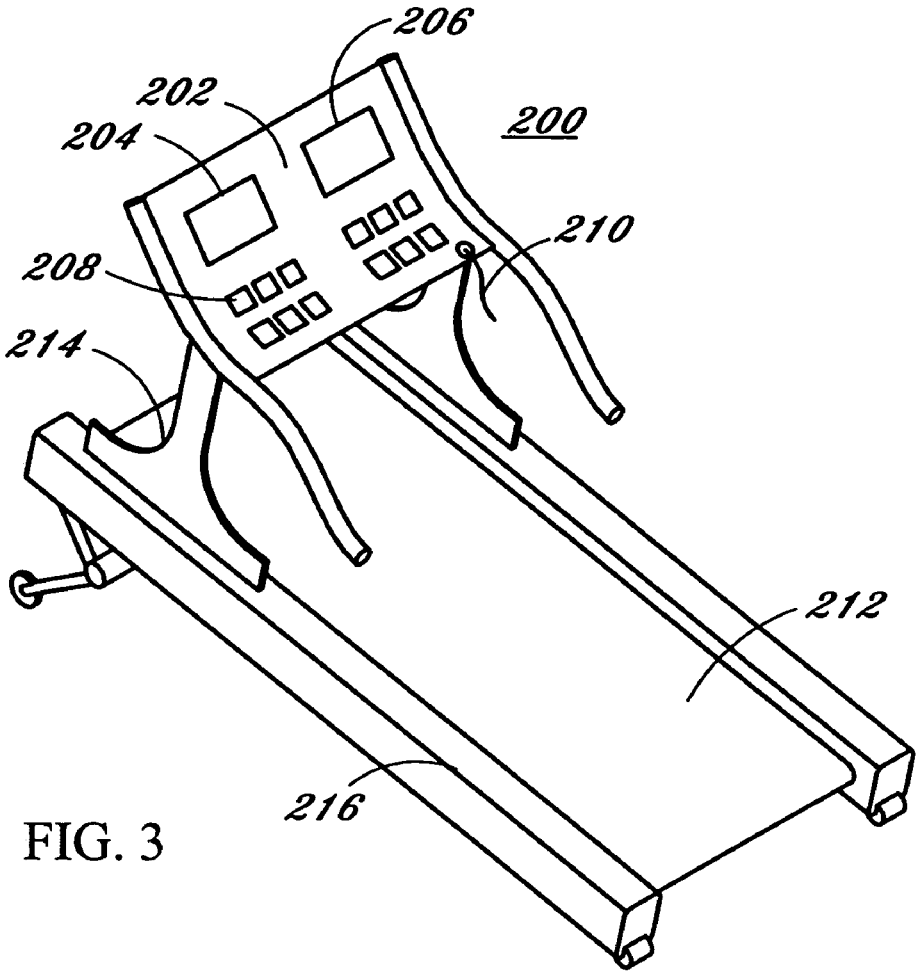
FIG. 3 diagrammatically illustrates a perspective view of a programmable treadmill incorporating the system of the present invention.
Figure 4:
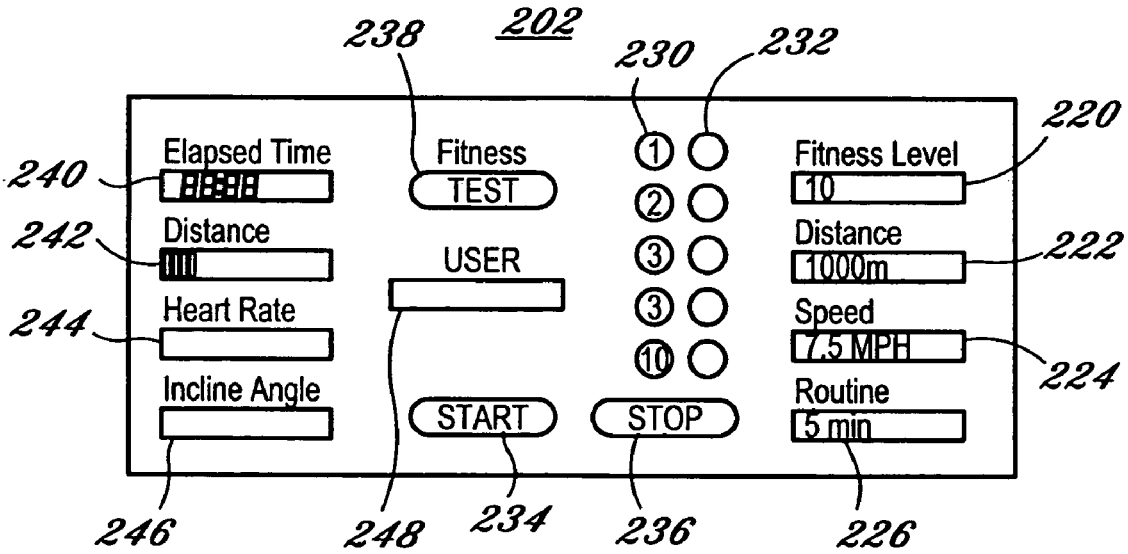
FIG. 4 diagrammatically illustrates a display panel of a treadmill programmed with the fitness system of the present invention.

FIG. 3 illustrates the general configuration of a programmable treadmill incorporating the system of the present invention into its program. Programmable treadmills are known in the art. U.S. Pat. No. 6,095,951 to Showronski, et al., and U.S. Pat. No. 6,626,803 to Oglesby, et al., disclose a microprocessor based exercise treadmill control systems, the teachings of which are incorporated herein by reference. Referring to FIG. 3, the treadmill of the present invention includes the standard equipment found on such treadmills, such as a control panel 202 with a set of displays 204, 206, and a set of workout control interfaces 208, 210. Typically, the control interfaces are buttons, but can be embodied in a number of different ways, including a touch screen. The control interface allows the user to turn the treadmill's power on and off, control the speed at which it runs, control the incline and decline if the treadmill is equipped with such lift capability, and in some instances comes with pre-programmed exercise routines. In FIG. 3, control panel 202 is secured to the frame structure 216 via support members 214 at either side and operatively connected to a control system. The control system is operatively connected to the motor and is capable of being programmed with instructions for the operation of the treadmill. Additionally, many come with a standard emergency cutoff 210 such that if the user falls from the treadmill belt and deck 212, the treadmill belt stops moving. Typical treadmills have a frame structure 216 that includes two rotatable pulleys positioned substantially parallel to each other, and a pair of spaced apart longitudinal frame members for providing longitudinal structural support for the frame structure. The treadmill is also equipped with a motor for rotating at least one of the pulleys and a belt 212 secured over the pulleys. When the motor turns the pulley, the belt moves in a longitudinal direction.

Alternatively, the system of the present invention is programmed into the microprocessor based controller of the treadmill to perform the process of the present invention. As shown in the prior art, the control system of the treadmill controls an AC motor that determines the speed at which the treadmill belt moves. The control system uses a microprocessor based controller to control the operation of the system. The control system also governs operation of the display panel, the user interface, the motor controller for the belt speed, the motor controller for the incline and decline, a failsafe cutoff switch, a heart monitoring input, and other inputs and outputs typically found on a treadmill.

Figure 5:
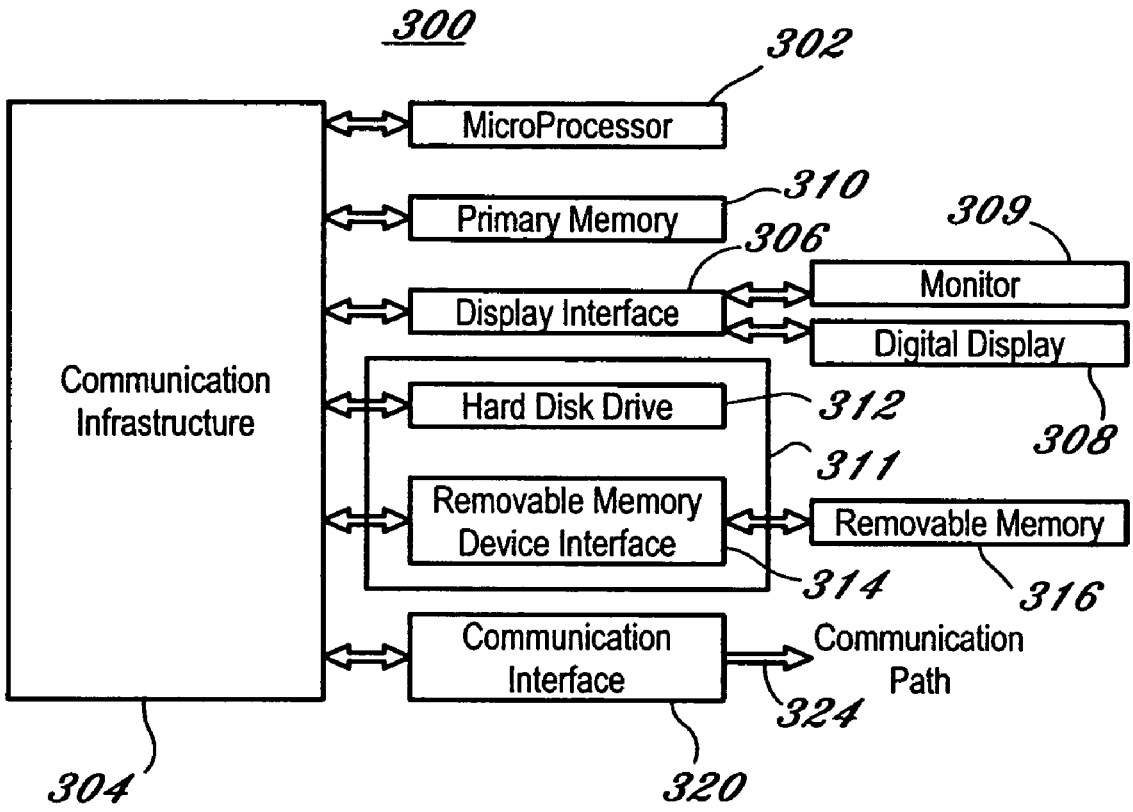
FIG. 5 is a block diagram illustrating a computer system useful for implementing an embodiment of the present invention.

FIG. 5 shows an exemplary embodiment of the display panel 202. The system of the present invention may be incorporated into programmable treadmills having a display that displays the steps explained in connection with use of the system as described with the chart 20 and slide 30 and the hand held electronic device of FIG. 2A. The display panel 202 illustrated in FIG. 5 includes four displays 220, 222, 224 and 226 that provide the user information about his or her fitness level, the distance for a particular exercise routine, the speed of the routine and the length of time for the routine, respectively. Adjacent to the four displays are five user input keys 230 labeled "1" through "5" corresponding to the prescribed or determined exercise regimens for a particular fitness level. To the right of the five input keys are five indicating lamps or LEDs 232 used to indicate what routines have been selected in the past. Included are input buttons for start 234, stop 236 and test 238. In addition, user display 248 displays information about the user. Because the panel of a treadmill provides more space for user inputs and outputs, the treadmill panel may provide information to the user as he or she is performing the test for measuring the fitness level as well as during the performance of an exercise routine within a exercise regimen based on that user's fitness level. Along the left of the panel 202 are displays for elapsed time 240, distance 242, heart rate 244 and incline angle 246, which are typically found on programmable treadmills. The programmable treadmill, in addition to incorporating programming instructions to carry out the fitness system of the present invention, may also incorporate programming instructions that allow each user to save his or her personal information such that that person is able to continue with the fitness system 10 of the present invention at another time. The treadmill may also be used without the fitness system of the present invention.

The system may also be embodied in a computer readable medium applicable to desktop computers, laptops, a networked based computer system, or a personal digital assistant (PDA). For example, the present invention may be embodied in a computer-readable medium such as a software program than can be sold for use in a personal computer, or a program available via a computer network such as the Internet, or for downloading into a PDA. FIG. 5 diagrammatically illustrates a block diagram of a computer system useful for implementing a computer readable medium embodiment of the present invention. The computer system 300 of FIG. 5 includes multiple processors, such as processor 302. The processors 302 are connected to a communication bus or infrastructure 304 (e.g., a communications bus, cross-over bar, or network). At least one cache (not shown) is also connected to the communication infrastructure 304. Various software embodiments are described in terms of this exemplary computer system 300. The invention is not limited to use with the computer system 300, but is also usable with other computer systems and/or computer architectures.

The computer system 300 alternatively includes a display interface 306 that forwards graphics, text, and other data from the communication infrastructure 304 (or from a frame buffer not shown) for presentation on the display monitor 309 or other display unit 308. The computer system 300 includes main memory 310. Main memory 310 may be random access memory (RAM), and alternatively includes a secondary memory. The secondary memory alternatively includes, a hard disk drive 312, a removable memory storage device interface 314, representing a floppy disk drive, a magnetic tape drive, an optical disk drive, etc. The removable memory storage device interface 314 reads from and/or writes to a removable memory storage unit 316 in a manner well known to those having ordinary skill in the art. Removable memory storage unit 316, represents a floppy disk, magnetic tape, optical disk, etc., which is read by and written to by removable storage device interface 314. As can be appreciated, the removable memory storage unit 316 includes a computer usable storage medium having stored therein computer software and/or data. In alternative embodiments, the secondary memory may include other similar means for allowing computer programs or other instructions to be loaded into the computer system 300. Such means may include, for example, a removable storage unit and an interface. Examples of such may include a program cartridge and cartridge interface (such as that found in video game devices), a removable memory chip (such as an EPROM, or PROM) and associated socket, and other removable storage units and interfaces that allow software and data to be transferred from the removable storage unit to the computer system 300.

The computer system 300 alternatively includes a communications interface 320. Communications interface 320 allows software and data to be transferred between the computer system and external devices. Examples of communications interface 320 may include a modem, a network interface (such as an Ethernet card), a communications port, and a PCMCIA® slot and <card, etc., (PCMCIA is a registered trademark of the Personal Computer Memory Card International Association). Software and data transferred via communications interface 320 are in the form of signals that include, for example, electronic, electromagnetic, optical, or other signals capable of being received by communications interface 320. These signals are provided to communications interface 320 via a communications path (i.e., channel) 324. This channel 324 carries signals and may be implemented using wire or cable, fiber optics, a phone line, a cellular phone link, an RF link, and/or other communications channels.

The terms "computer program medium," "computer-usable medium," "machine-readable medium" and "computer-readable medium" are used to generally refer to media such as primary, or main, memory 310 and secondary memory 311, removable storage device interface 314, a hard disk installed in hard disk drive 312, and signals. These computer program products are means for providing software to the computer system. The computer-readable medium allows the computer system to read data, instructions, messages or message packets, and other computer-readable information from the computer-readable medium. The computer-readable medium, for example, may include non-volatile memory, such as floppy, ROM, FLASH® memory (FLASH is a registered trademark of the Macromedia Company), disk drive memory, CD-ROM, and other permanent storage. By way of example, it is useful for transporting information, such as data and computer instructions, between computer systems. The computer-readable medium may include computer-readable information in a transitory state medium such as a network link and/or a network interface, including a wired network or a wireless network, that a computer can read. Computer programs (also called computer control logic) are stored in main memory 310 and/or secondary memory 311. Computer programs may also be received via communications interface 320. Such computer programs, when executed, enable the computer system to perform the features of the present invention as discussed herein. In particular, the computer programs, when executed, enable the processor 302 to perform the features of the computer system. Accordingly, such computer programs represent controllers of the computer system.

The microprocessor-based controller of the treadmill, the portable programmable electronic device, the portable electronic device having positioning technology or the computer readable medium application may be realized in a number of combinations of hardware, software or a combination of the two. An embodiment of the present invention can be embedded in a computer program product that includes all the features enabling implementation of the methods described herein, and which, when loaded in a system, is able to carry out these methods. A computer program as used in the present invention indicates any expression, in any language, code or notation, of a set of instructions intended to cause a system having an information processing capability to perform a particular function either directly or after either or both of the following: (1) a conversion to another language, code or notation; and (2) reproduction in a different material form. A system may include, inter alia, one or more information processing systems and/or computer processors and at least a machine-readable or computer-readable medium, allowing a system to read data, instructions, messages or message packets, and other information form the machine-readable or computer-readable medium.

Although specific embodiments of the invention have been disclosed, those having ordinary skill in the art will understand that changes can be made to the specific embodiments without departing from the spirit and scope of the invention. Still other embodiments may be constructed. The scope of the invention is not to be restricted, therefore, to the specific embodiments. It is intended that the appended claims cover any and all such applications, modifications, and embodiments within the scope and spirit of the present invention.

What is claimed is:

1. A portable, electronic fitness training device comprising:

a memory adapted to store user entered data and an operating program;

a user interface adapted to enable a user to enter said user entered data into said memory and to communicate information to the user;

a location signal receiver adapted to receive location signals from a plurality of sources external to the fitness training device;

a command and control circuit coupled to said memory, to said user interface and to said location signal receiver, said command and control circuit capable of executing said program, performing mathematical calculations, and generating control signals based upon said user entered data and said location signals from said location signal receiver, whereby the fitness training device is adapted to prompt the user to begin an exercise routine and whereby the device is capable of determining the distance traveled by the device during an exercise routine based upon said location signals and thereby determine a fitness level of the person upon completion of said exercise routine, and whereby said program determines a plurality of timed exercise regimens based upon said fitness level.

2. An electronic fitness training device as claimed in claim 1 wherein said plurality of timed exercise regimens further comprises five exercise regimens.

3. An electronic fitness training device as claimed in claim 2 wherein said five exercise regimens further comprise:

a first exercise regimen comprising ten, 1-minute exercise routines with 1-minute rest intervals between each said 1-minute exercise routine;

a second exercise regimen comprising eight, 2-minute exercise routines with 2-minute rest intervals between each said 2-minute exercise routine;

a third exercise regimen comprising seven, 3-minute exercise routines with 3-minute rest intervals between each said 3-minute exercise routine;

a fourth exercise regimen comprising five, 5-minute exercise routines with 5-minute rest intervals between each said 5-minute exercise routine; and a fifth exercise regimen comprising one, 10-minute exercise routine.

4. An electronic fitness training device as claimed in claim 3 wherein said user interface includes a display and said command and control circuit causes said display to display said plurality of exercise regimens and prompts the user to select an exercise regimen from among the displayed plurality of exercise regimens.

5. An electronic fitness training device as claimed in claim 4 wherein said displayed plurality of exercise regimens is presented as part of a table having fitness levels indicated along a vertical axis and time indicated along a horizontal axis.

6. An electronic fitness training device as claimed in claim 1 wherein said user interface includes a display and said command and control circuit causes said display to display said plurality of exercise regimens and prompts the user to select an exercise regimen from among the displayed plurality of exercise regimens.

7. An electronic fitness training device as claimed in claim 6 wherein said displayed plurality of exercise regimens is presented as part of a table having fitness levels indicated along a vertical axis and time indicated along a horizontal axis.

8. A portable, electronic fitness training device comprising:

a memory adapted to store user entered data and an operating program;

a user interface adapted to enable a user to enter said user entered data into said memory and to communicate information to the user, a location signal receiver adapted to receive location signals from a plurality of sources external to the fitness training device;

a command and control circuit coupled to said memory, to said user interface and to said location signal receiver, said command and control circuit capable of executing said program, performing mathematical calculations, and generating control signals based upon said user entered data and said location signals from said location signal receiver, whereby the fitness training device is adapted to prompt the user to begin an exercise routine and whereby the device is capable of determining the distance traveled by the device during an exercise routine based upon said location signals and thereby determine a fitness level of the person upon completion of said exercise routine, and whereby said program determines five timed exercise regimens based upon said fitness level, said five exercise regimens comprising a first exercise regimen comprising ten, 1-minute exercise routines with 1-minute rest intervals between each said 1-minute exercise routine;

a second exercise regimen comprising eight, 2-minute exercise routines with 2-minute rest intervals between each said 2-minute exercise routine;

a third exercise regimen comprising seven, 3-minute exercise routines with 3-minute rest intervals between each said 3-minute exercise routine;

a fourth exercise regimen comprising five, 5-minute exercise routines with 5-minute rest intervals between each said 5-minute exercise routine; and a fifth exercise regimen comprising one, 10-minute exercise routine.

9. An electronic fitness training device as claimed in claim 8 wherein said user interface includes a display and said command and control circuit causes said display to display said exercise regimens and prompts the user to select an exercise regimen from among the displayed exercise regimens.

10. An electronic fitness training device as claimed in claim 9 wherein said displayed exercise regimens is presented as part of a table having fitness levels indicated along a vertical axis and time indicated along a horizontal axis.

* * * * *